US005217060A

United States Patent [19]

Lazzaro

[11] Patent Number: 5,217,060

[45] Date of Patent: Jun. 8, 1993

[54] CONTINUOUS CASTING APPARATUS HAVING A MOBILE BOTTOM CLOSURE/SUPPORT

[75] Inventor: Giuseppe Lazzaro, Portoscuso Ca, Italy

[73] Assignee: Alures S.C.p.A., Portoscuso Ca, Italy

[21] Appl. No.: 810,703

[22] Filed: Dec. 18, 1991

[30] Foreign Application Priority Data

Dec. 20, 1990 [IT] Italy ..... 22469 A/90

[51] Int. Cl.[5] ..... B22D 11/08

[52] U.S. Cl. ..... 164/425; 164/445

[58] Field of Search ..... 164/445, 446, 425, 426, 164/483

[56] References Cited

U.S. PATENT DOCUMENTS

| | | | |
|---|---|---|---|
| 3,384,152 | 5/1968 | Olsen et al. | 164/425 |
| 3,702,152 | 11/1972 | Bryson | 164/425 X |
| 3,702,631 | 11/1972 | Sergerie | 164/425 |
| 3,847,206 | 11/1974 | Foye | 164/425 |
| 3,877,508 | 4/1975 | Bryson | 164/445 |
| 3,948,310 | 4/1976 | Deschapelles | 164/425 |
| 3,957,105 | 5/1976 | Foye | 164/425 |
| 4,509,580 | 4/1985 | Goodrich | 164/445 |

FOREIGN PATENT DOCUMENTS

| | | | |
|---|---|---|---|
| 57-9563 | 1/1982 | Japan | 164/425 |
| 1-205851 | 8/1989 | Japan | 164/425 |
| 665577 | 5/1988 | Switzerland | 164/446 |

*Primary Examiner*—J. Reed Batten, Jr.
*Attorney, Agent, or Firm*—Collard & Roe

[57] ABSTRACT

A mobile bottom closure/support includes a metal disc-shaped body, having at its top a suitable diameter for allowing the body to be translated inside a crystallizer-collar and having, at its bottom, a larger diameter. The disc-shaped body includes a pair of disc-shaped plates made from metal materials with different values of heat conductivity and concentrically superimposed to each other. The upper disc-shaped plate has at least a portion of its external cylindrical surface with such a diameter as to enable the plate to be translated inside the crystallizer-collar. The lower disc-shaped plate has a greater diameter, suitable for enabling the disc-shaped body to remain guided, coaxially with the collar, between vertical trueing elements angularly spaced apart from one another and integral with the collar. The base plane of the disc-shaped body is removably affixed to a planar surface support, vertically translatable in a known way, so as to enable the solidified shaped casting to be discharged while it is anchored to the upper plate.

8 Claims, 3 Drawing Sheets

CONTINUOUS CASTING APPARATUS HAVING A MOBILE BOTTOM CLOSURE/SUPPORT

DESCRIPTION

Figure 1:
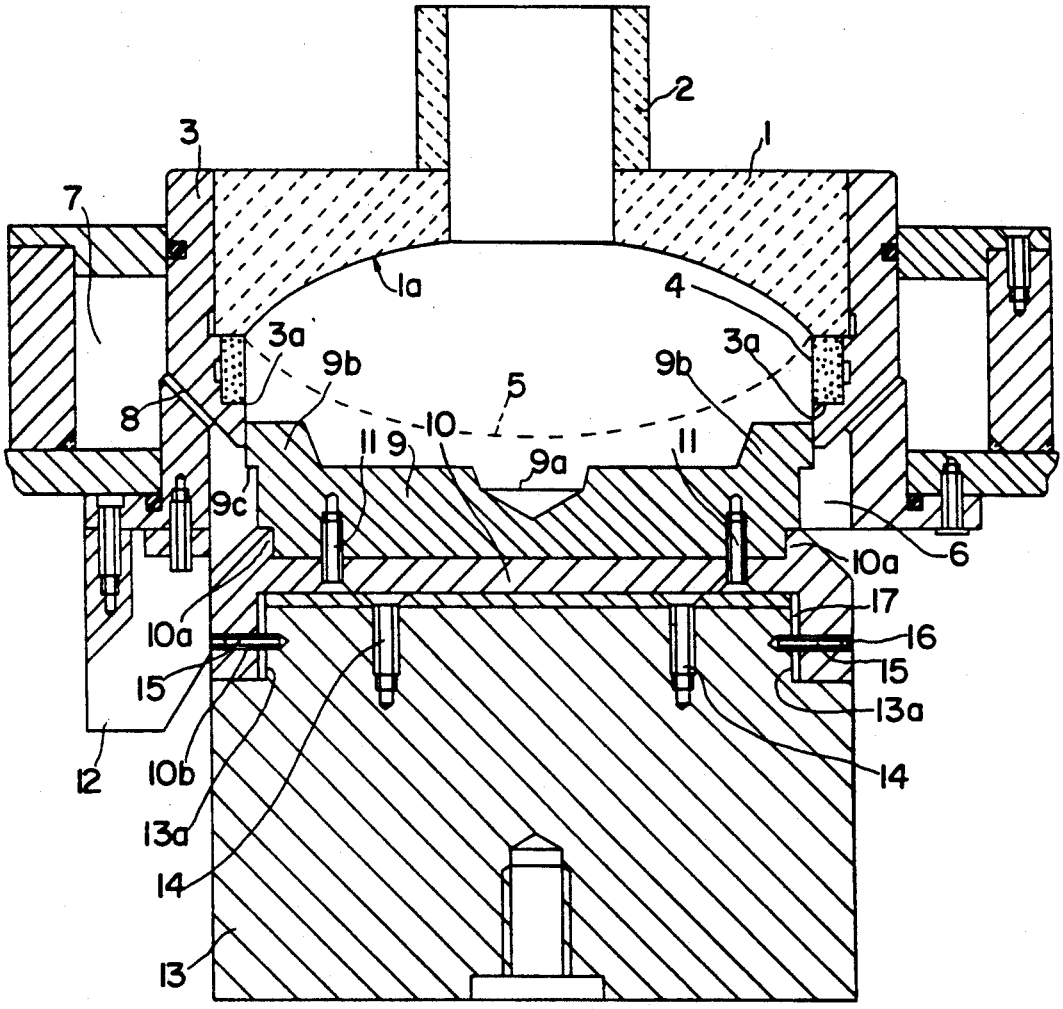

The present invention relates to a self-trueing mobile bottom closure/support means translatable in the vertical direction, used to support the solidified shaped castings manufactured by means of vertical casting apparatuses for casting light alloys in general, and aluminum and its alloys in particular. The present techniques for vertically casting light alloys and aluminum and its alloys, and, in particular, the pressure casting techniques, use, as known, apparatuses equipped with a liquid metal feeding nozzle made from a refractory material, which, at its bottom side, is into communication with a tundish having the shape of a cylindrical plug with an inner concavity, also made from a heat-insulating, refractory material, and, at its top side, with a duct through which the liquid metal coming from a smelting furnace is fed.

Said tundish is positioned above an annular, metal body, generally known as "crystallizer-collar", inside which there is, horizontally positioned, a vertically mobile bottom closure/support means, suitable for supporting and removing the metal cast body ("billet") which results from cast metal solidification. Around the collar, the bottom closure/support means and the shaped casting during the extraction step, a cooling water flow is provided, and between said collar and the lower peripheral edge of said plug-shaped tundish, i.e., in the annular region wherein the solidification step begins, a lubricating ring of graphite is normally provided, to which metered amounts of a liquid lubricant media coming from a suitable tank are fed by gravity, or by mechanical means. The lubricating ring performs the function of favouring the release of the metal from the collar during the solidification step.

It is also known, as well, that said lubricating ring and said collar must retain their integrity during the reciprocating motion of the bottom closure/support means, and, in order to secure this proviso, said bottom closure/support means must be given such a structure, and must be guided along its reciprocating motion strokes, in such a way as to be always perfectly trued relatively to said collar; in fact, any possible bottom closure/support means trueing errors-due to deformations caused by the heating of said bottom closure/support means deriving from its contact with the liquid metal, or by defects in the guide of the stem which actuates said bottom closure/support means-can cause damages to occur to the collar and to the lubricating ring, and can also alter the conditions of cooling water distribution.

Furthermore, serious problems exist, which are connected with the stability of anchoring of the casting to the underlying bottom closure/support means during the solidification step, with the bottom closure/support means cooling times and conditions, and with the deformations and/or oxidations which the same bottom closure/support means may undergo during its stay in cooling water; all these operating conditions have a quite decisive influence on the casting operating stability over time and on the quality of the solidified casting obtained.

A purpose of the present invention is to provide a mobile bottom closure/support means for a vertical casting apparatus, for either traditional casting or pressure casting of light alloys in general and, in particular, aluminum and its alloys. The mobile bottom closure/-support means has such a structure and dimensions as to obviate the drawbacks displayed by the traditional mobile bottom closure/support means and enables a correct cooling of the metal to take place in the solidification region. A stable anchoring is achieved of the shaped casting, during the solidification step, onto the upper side of the bottom closure/support means, and such as to result perfectly trued relative to the crystallizer-collar and to the relevant lubricant ring, if present, thus eliminating any risks of damages to the same collar and lubricant ring.

Another purpose is to provide a mobile bottom closure/support means, which is easily and rapidly coupled to the vertically translatable support. The mobile bottom closure/support means is also suitable for use on vertical casting-either pressure casting or traditional, float casting-apparatuses, without requiring substantial structural modifications.

These and still other purposes, which are better set forth by the following disclosure, are achieved by means of a mobile bottom closure/support means for apparatuses for vertical casting of light alloys in general, which bottom closure/support means is constituted, according to the present invention, by a metal disc-shaped body having at its top a suitable diameter for allowing said body to be translated, in horizontal position, inside the crystallizer-collar and having, at its bottom, a larger diameter, suitable for enabling said disc-shaped body to remain guided, coaxially with said collar, between vertical trueing elements angularly spaced apart from one another and connected with said collar, with the base of said disc-shaped body being associated with a planar-surface support by means of coupling means suitable for enabling the disc-shaped body to only undergo limited horizontal movements in all directions relative to the support, so as to enable said bottom closure/support means, at each rising stroke of said support, to self-true relatively to said trueing elements, and then to enter into the crystallizer-collar in an already perfectly trued relationship with the latter.

Said disc-shaped body is preferably constituted by a pair of disc-shaped plates concentrically superimposed to each other and anchored to each other by means of screws or similar fastening means, with said disc-shaped plates being made from metal materials with different values of heat conductivity, and the upper disc-shaped plate having at least a portion of its external cylindrical surface with such a diameter as to enable said plate to be translated, in horizontal position, inside the crystallizer-collar, whereas the lower disc-shaped plate has a longer diameter, suitable for enabling both said mutually superimposed plates to remain guided, coaxially with said collar, between said vertical trueing elements, with the base plane of said pair of plates being removably anchored to said planar-surface support, vertically-translatable, so as to carry out the extrusion of the solidified shaped casting.

More particularly, said upper disc-shaped plate which is destined to come into contact with liquid metal, is made of steel, cast iron, aluminum or metal alloys, i.e., of materials with a high heat conductivity, in order to facilitate the heat transfer towards the edge of the plate, peripherally cooled, whereas said lower plate, integral with the translatable support, is made from an abrasion-resistant steel, or other abrasion-resistant metal materials with a lower heat conductivity than of the upper plate, in order to prevent the shaped casting from cooling two fast during its initial solidification step.

Said coupling means include horizontal peripheral studs, i.e., substantially three studs angularly spaced apart at 120° from one another, suitable for coupling, with axial clearance, an annular edge downwards protruding from said bottom closure/support means, inside an external, annular groove provided on the support, with the clearance between the annular edge and the groove enabling the bottom closure/support means to perform the required translational and horizontal rotation movements relative to the support.

Furthermore, in order to allow said disc-shaped body to horizontally translate on the support, in order to reach a trued position relatively to the collar, the free bottom ends of said trueing elements are made diagonally chamfered, so as to constitute a guide for said disc-shaped body entering between the trueing elements, thereby preventing any possible sticking thereof against the ends of said trueing elements.

Figure 2:
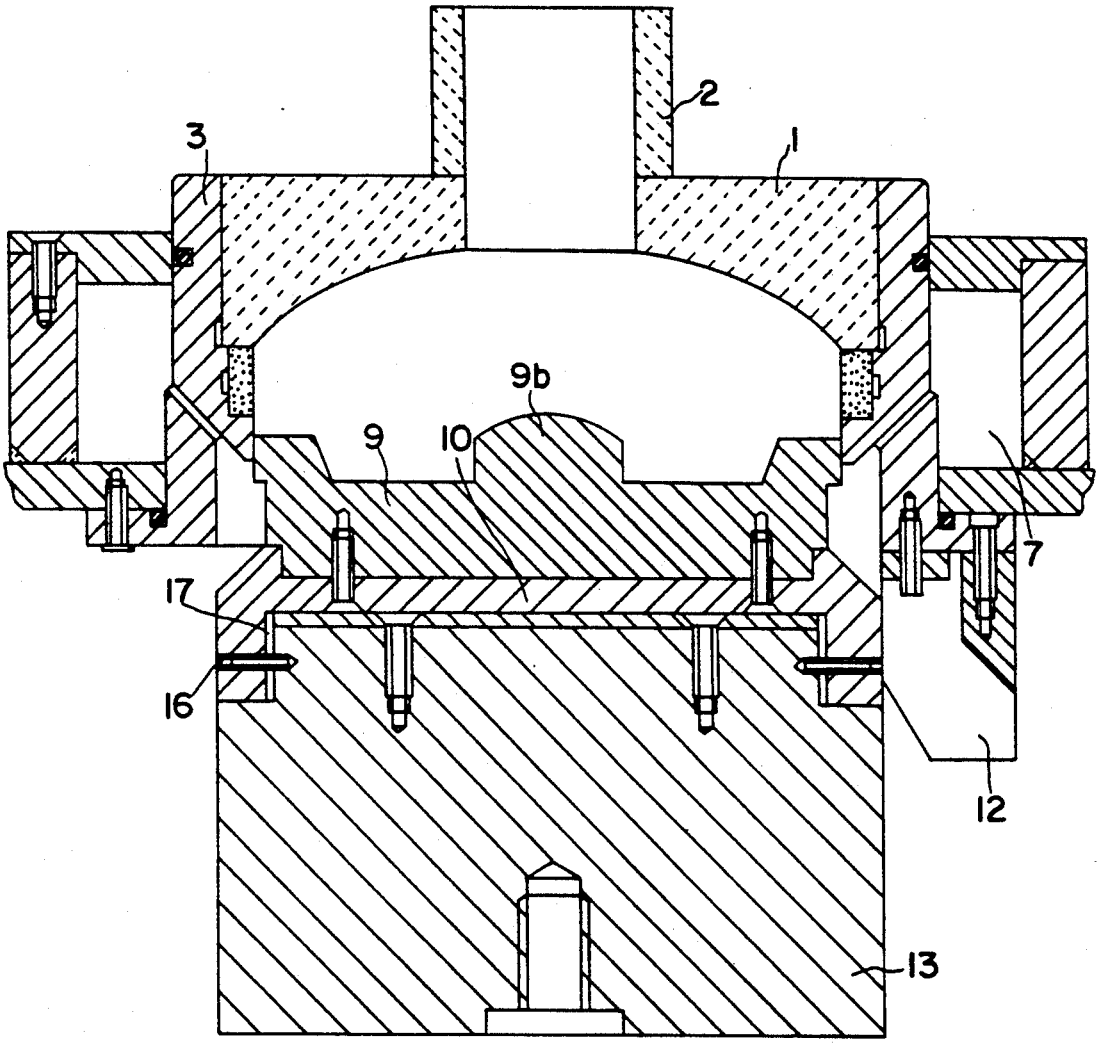
Figure 3:
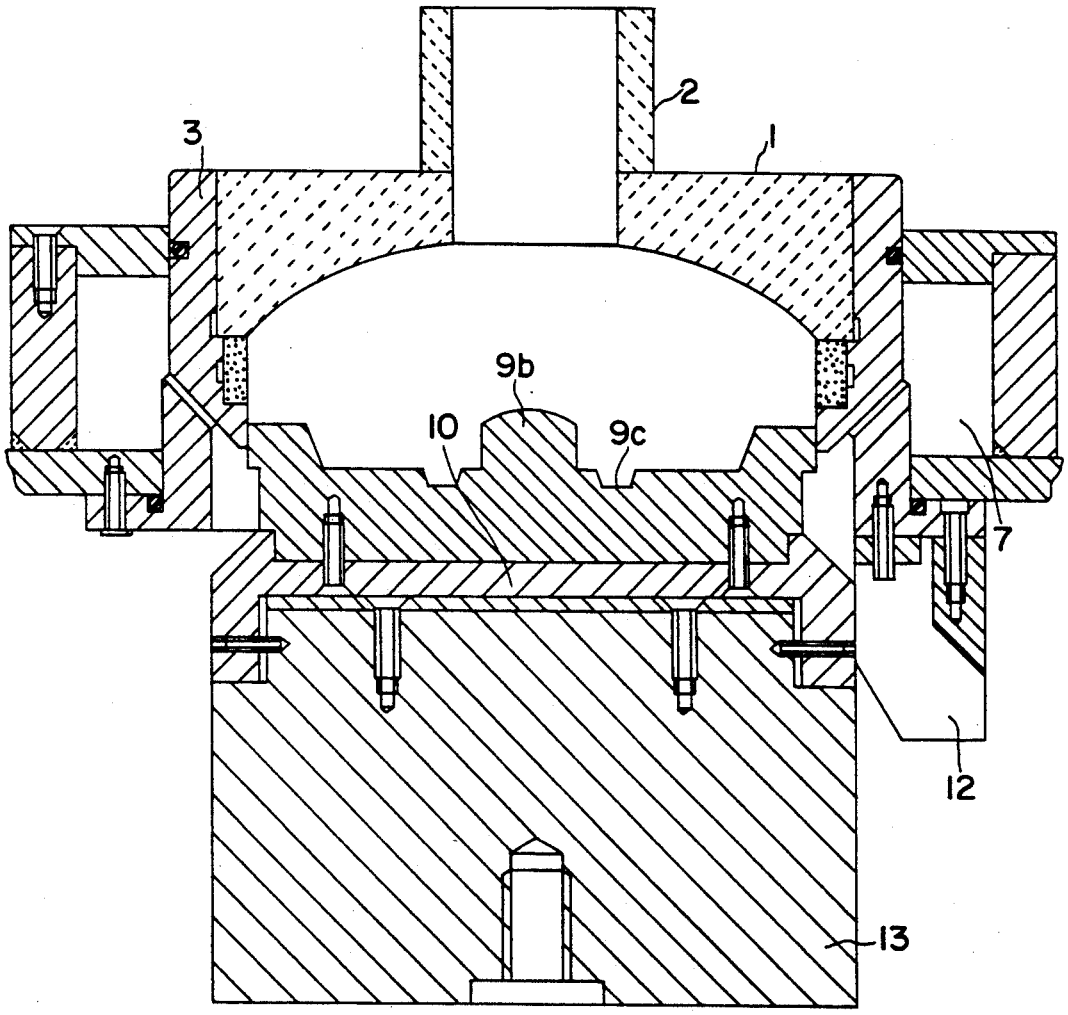

Further characteristics and advantages of the instant finding will be clearer from the following disclosure in detail of some forms of practical embodiment thereof, made by referring to the accompanying drawing tables, supplied for merely indicative, non-limitative purposes, in which:

FIG. 1 shows, schematically and in axial-diametrical section, a pressure casting apparatus containing a bottom closure/support means accomplished according to the present invention; and FIGS. 2 and 3 show, also in axial-diametrical section, the apparatus of FIG. 1 with a bottom closure/support means with a different superior shape, in order to improve the anchoring of the shaped casting in course of solidification.

Referring to said figures, the mobile bottom closure/-support means according to the present invention can be used, as already said, on apparatuses for vertical pressure casting, i.e., on casting apparatuses substantially like those as schematically shown in the accompanying drawings.

The apparatus depicted in the figures includes a casting chamber defined by a cylindrical plug 1 with an inner concavity 1*a*, made of a heat-insulating refractory material, which cylindrical plug is centrally connected with a nozzle 2 suitable for feeding the liquid metal coming from the smelting furnace (not shown in the figures). The nozzle is also made of a refractory material. The plug 1 is positioned, in tight-sealing relationship, inside a metal ring 3, normally made from aluminum, which constitutes the crystallizer-collar. Such a collar 3 has its inner, cylindrical surface 3*a* with a very short height, so as to provide, in conjunction with said cylindrical plug, the best operating conditions.

Between the peripheral edge of the plug 1 and the upper, horizontal edge of the collar 3 a lubricating ring 4, made of graphite or another porous material, is provided and is continuously fed, with preset flow rates, with lubricating oil fed under pressure through an external duct, not shown in the figures. As known, the lubricating ring 4 performs the task of delivering oil onto the collar surface, in order to facilitate the detachment of the metal which starts solidifying substantially in the region of the lubricating ring, according to a meniscus schematically shown in dashed line in FIG. 1, and indicated with the reference numeral 5. Outside the crystallizer-collar a substantially cylindrical chamber 6 is provided, inside which cooling water, coming from a buffer tank 7, is continuously fed through openings 8.

Inside the interior of the crystallizer-collar 3, a horizontal disc-shaped body is mounted, which can be vertically translated in both directions and constitutes the bottom closure/support means destined to support and allow the shaped casting to be removed, which is formed due to the successive solidification of the liquid metal, which takes place as the bottom closure/support means sinks. In that way, a solid shaped casting, normally designated "billet", is formed.

The bottom closure/support means is given a structure which results in automatically self-trueing relative to the collar, so as to not damage said collar during its rising strokes. According to the finding, the bottom closure/support means is constituted by a disc-shaped body with substantially two diameters; the diameter of the upper portion is such as to enable said bottom closure/support means to slide, substantially in a tight-sealing relationship, inside said collar, whereas the diameter of the lower portion is greater than the upper portion. The lower portion is destined to remain guided between the trueing elements positioned angularly spaced apart from one another, e.g., in a number of 3 or 4, and vertically supported by the collar. The cylindrical surfaces of the individual trueing elements are so accomplished, as to define a cylindrical surface, which is perfectly coaxial with the cylindrical surface of the collar, and has a greater diameter than said collar. Said trueing elements have their lower free ends diagonally chamfered, so as to constitute a guide for the lower, longer-diameter portion of the bottom closure/support means entering between the trueing elements, without sticking, when said bottom closure/support means moves upwards towards the collar. The bottom closure/support means depicted in FIG. 1 includes two disc-shaped bodies 9 and 10, having different thicknesses, concentrically superimposed to each other, and stably irremovably coupled to each other by means of a plurality of fastening screws 11.

Said bodies substantially are two mutually superimposed plates having opposite planar, circular faces and with their respective peripheral cylindrical surfaces being differently contoured.

In fact, the upper plate 9 has its face destined to come into contact with the liquid metal, provided with a hollow contour, as indicated with 9*a* in FIG. 1, and a peripheral edge 9*b* protruding upwards relatively to the same face. The diameter of the external cylindrical surface 9*c* of said edge, limited to the thickness of the same edge, is given such a structure as to enable the plate 9 to slide, in a substantially tight-sealing relationship, on the inner cylindrical surface 3*a* of the collar 3.

On the contrary, the lower plate 10, with opposite planar faces, has an outer diameter which is greater than the diameter of the plate 9, and is destined to slide, in a guided fashion, between trueing elements 12 positioned angularly spaced apart from each other and vertically supported, parallel to one another, by the collar 3. Said trueing elements each have a cylindrical surface, all with the same radius, so, as a whole, they define a cylindrical surface-even if interrupted-which is perfectly coaxial with the cylindrical surface of the collar.

Furthermore, in order to secure a perfect coaxiality of the superimposed plates 9 and 10 which constitute the mobile bottom closure/support means, the lower plate 10 displays, along its periphery, an annular shoulder 10*a* housed inside a corresponding annular recess peripherally provided in the base of the upper plate 9. In order to secure the perfect coaxiality of the composite bottom closure/support means 9–10, relative to the vertically translatable support 13 to which said bottom closure/support means is rigidly affixed by means of screws 14, the lower plate 10 displays a peripheral edge 10*b* inserted inside a corresponding seat 13*a*, peripherally provided in said support 13. Transversely to the edge 10*b* of the lower plate, equally spaced screws 15 are inserted which, besides stiffening the connection between the plate 10 and the support 13, enable short relative shifts between the plate and the support, on a horizontal plane, in order to accomplish a perfect mutual trueing of said plate 10 and support 13.

With reference to FIG. 1, the means for coupling the base of the disc-shaped body 9, 10 with the planar surface of the vertically translatable support 13 are the horizontal studs 15 fixed into the annular edge 10*b* of the plate 10. These studs couple, with an axial clearance 16, the annular edge 10*b* of the bottom closure/support inside the annular groove 13*a* provided on the vertically translatable support 13. An annular space 17 between the bottom closure means and the edge of the translatable support 13 is provided, within which annular space, due to the axial clearances 16, the bottom closure means can be adjusted and self-centered during its rising stroke.

Still according to the invention, in order to improve the operating conditions of the casting process, the upper plate 9 is made of a metal material (steel, cast iron, aluminum or other metals) endowed with a good heat conductivity, capable of favouring the transfer of heat released by the liquid metal during its solidification step, towards the peripheral edges of the same plate, and of the collar, which are cooled by circulating water, with self-explainatory advantages as regards the stability of the anchoring between the upper plate 9, and, in particular, of its recess 9*a*, and the shaped casting during the solidification step. On the contrary, the lower plate 10 is made of steel, or another metal material, endowed with abrasion-resistance characteristics, and with a lower heat conductivity than of the upper plate 9, in order to prevent the liquid metal existing on the upper plate from cooling too rapidly; in fact, an excessively fast cooling of liquid metal may cause the drawback that the bottom closure/support means does not get stably anchored to the shaped casting, and consequently that the same bottom closure/support means does not succeed in dragging said shaped casting; in this case, the sticking of the shaped casting inside the collar-and hence, the loss of said shaped casting-would result.

In particular, in practice, the combination of two plates with different characteristics forming the bottom closure/support means makes it possible to reach a good operating stability of the casting process over time, due to the effect of reduction in deformations and/or oxidations caused by the plates of the bottom closure/support means staying in water.

Finally, in order to improve the anchoring of the shaped casting to the upper surface of the plate 9, besides the recess 9*a* shown in FIG. 1, also a dome-shaped body 9*b* centrally protruding from the plate 9, as shown in FIG. 2, or a semi-cylindrical groove 9*c*, or the like, provided in the body 9 concentrically to the dome 9*b*, as illustrated in FIG. 3, showed to be particularly effective.

In addition to these structural modifications, further structurally and functionally equivalent changes and variations may be supplied to the present finding as herein disclosed and illustrated, without departing from the scope of protection of the same finding.

I claim:

1. An apparatus for casting light alloys comprising:

a crystallizer-collar including trueing elements protruding vertically downward at spaced intervals from said crystallizer-collar;

a vertically translatable support with a planar surface;

a mobile bottom closure/support including a metal disc having an upper portion with a diameter configured and dimensioned to be slidingly received within said crystallizer-collar and a lower portion with a diameter larger than said upper portion, configured and dimensioned to be slidingly guided between said trueing elements and coaxial with said crystallizer-collar; and coupling means for flexibly coupling said lower portion of said disc to said planar surface of said vertically translatable support and allowing limited horizontal movement of said disc in all directions relative to said vertically translatable support, so that during a rising stroke of said vertically translatable support said lower portion of said mobile bottom closure/support is self-guided between said trueing elements, whereby said upper portion enters said crystallizer-collar pre-aligned.

2. The apparatus for casting light alloys according to claim 1, wherein said upper portion and said lower portion are each a disc-shaped metal plate concentrically attached to each other, said upper plate having a water-cooled periphery and a heat conductivity selected to facilitate heat transfer from a solidifying casting to the water-cooled periphery, said lower plate being made from an abrasion resistant material having a lower heat conductivity than said upper plate to prevent the casting from cooling too fast during an incipient solidification step.

3. The apparatus for casting light alloys according to claim 2, wherein one of said plates includes a peripheral annular edge and the other of said plates includes a corresponding annular indentation for receiving said annular edge to coaxially attach said plates.

4. The apparatus for casting light alloys according to claim 3, wherein said upper plate includes a surface for contacting the casting and anchoring means to secure the casting to said surface during the solidification step.

5. The apparatus for casting light alloys according to claim 4, wherein said anchoring means includes at least one hollow in said surface.

6. The apparatus for casting light alloys according to claim 4, wherein said anchoring means includes at least one conically-shaped protrusion surrounded by a concentric semi-cylindrical groove.

7. The apparatus for casting light alloys according to claim 6, wherein said lower portion includes an annular edge along a periphery and said vertically translatable support includes an annular groove along a peripheral edge for receiving said lower portion annular edge.

8. The apparatus for casting light alloys according to claim 7, wherein said trueing elements have a lower free end with an arcuate inner surface and a radius equal to a radius of said lower portion, the free ends being chamfered to form an entering guide for said lower portion of said bottom closure/support during the rising stroke.

* * * * *